US005191835A

United States Patent [19]

Blanchard

[11] Patent Number: 5,191,835

[45] Date of Patent: Mar. 9, 1993

[54] FILM DAMPENING SYSTEM FOR A ROTARY OFFSET PRESS

[75] Inventor: Alain Blanchard, Chantilly, France

[73] Assignee: Heidelberg Harris GmbH, Heidelberg, Fed. Rep. of Germany

[21] Appl. No.: 720,221

[22] Filed: Jun. 21, 1991

[30] Foreign Application Priority Data

Jun. 21, 1990 [FR] France ..... 90 07769

[51] Int. Cl.[5] ..... B41L 25/16

[52] U.S. Cl. ..... 101/148; 101/351

[58] Field of Search ..... 101/147, 148, 207, 208, 101/209, 210, 350, 351, 352

[56] References Cited

U.S. PATENT DOCUMENTS

| | | | |
|---|---|---|---|
| 3,986,452 | 10/1976 | Dahlgren | 101/148 |
| 4,567,823 | 2/1986 | Hummel et al. | 101/352 |
| 4,729,308 | 3/1988 | Witczak | 101/148 |
| 4,821,641 | 4/1989 | Kowalik et al. | 101/148 |
| 4,972,771 | 11/1990 | Weisgerber et al. | 101/352 |
| 4,991,502 | 2/1991 | Akao | 101/148 |
| 5,042,377 | 8/1991 | Palecek et al. | 101/148 |

*Primary Examiner*—Clifford D. Crowder

*Assistant Examiner*—Stephen R. Funk

*Attorney, Agent, or Firm*—Kenyon & Kenyon

[57] ABSTRACT

A film dampening system for a rotary offset press has a pan roller (101) rotated by a variable speed electric motor (111), the pan roller being covered with a hydrophilic material and being partially immersed in a trough (107) containing dampening solutions; an elastomer-covered metering roller (102) rotating at a speed related to the speed of the pan roller (101); a dampening drum (103) fitted with hydrophilic material; and an elastomer-covered dampening roller (104) in contact with the dampening drum (103) and with the plate cylinder (105) of the press. The dampening drum (103) is selectively driven either from the metering roller (102), in which case inter-roller differential slipping is established between the dampening drum and the dampening roller (104), or else from the plate cylinder (105), in which case inter-roller differential slipping is established between the dampening drum and the metering roller (102), the selective drive for the dampening drum (103) thus making it equally possible to use either one of two different dampening modes. The film dampening system is applicable to the field of offset printing.

18 Claims, 7 Drawing Sheets

FILM DAMPENING SYSTEM FOR A ROTARY OFFSET PRESS

FIELD OF THE INVENTION

The present invention relates to the field of printing and, more particularly, to dampening systems for offset rotary presses, which may be sheet-fed or web-fed.

BACKGROUND INFORMATION

It is well known that the operation of rotary offset presses is based on the repulsion exerted by a dampened surface on greasy ink. As a result, such presses are necessarily fitted with a dampening system whose primary function is to deposit a uniform film of aqueous solution on the printing plate which is fitted around the plate cylinder. This film must be very thin (thickness about 1 micrometer), and it must be very uniform. The slightest non-uniformity leads to a change in the optical density of the printed signature (the uniformity of the optical density is spoiled), and this gives rise to a defect which is more or less easily visible on the printed signature. In general, the aqueous solution used includes certain additives, in particular, isopropyl alcohol, for reducing its surface tension, and/or citric acid for cleaning the plate.

There are thus various different dampening systems commonly to be found on rotary offset presses, be they sheet-fed or web-fed.

Mention may initially be made of alternating ductor dampening systems.

Systems of this type comprise firstly a metal pan roller which is partially immersed in a trough containing the dampening solution and which is rotated slowly by an independent electric motor, and secondly a pair of rollers rotating at machine speed (quickly), namely a chromium-plated metal roller constituting a dampening drum, and a rubber-covered dampening roller in contact with the plate cylinder. The dampening roller is usually fitted with a cloth sleeve to provide spare capacity. Another roller, referred to as a "ductor" roller, is mounted on a reciprocating bracket and is thus capable of making contact alternately with the pan roller and with the dampening drum, thereby transferring the film of dampening solution from one group of rollers to the other.

Such systems are being used less and less today, since the uniformity of the moistening film they provide is not perfect, and since they also require the use of a cloth sleeve on the dampening roller, which sleeve is subject to rapid wear and must be replaced periodically.

Mention may also be made of brush dampening systems.

Systems of this type serve to spray moistening solution onto the dampening vibrator by using a circular brush having the end of its bristles dipping into a trough of solution and coming into contact with fixed scrapers which deflect the bristles of the brush, thereby spraying droplets onto the dampening vibrator. The dampening solution is thus fed permanently to the pair of rollers that rotate at machine speed (the chromium-plated dampening drum and the rubber-covered dampening roller). In a variant, the circular brush rubs against a pan roller which is partially immersed in the solution, with the bristles of the brush spraying droplets as they go past.

Such systems, and other spray dampening systems, are typically not satisfactory, as the film obtained is never perfectly uniform because droplet spraying is relatively random.

In order to avoid the above-mentioned drawbacks of dampening systems using a brush or an alternating ductor, proposals have been made for so-called "film" dampening systems.

In general, film dampening systems include two groups of rollers. A first group of rollers takes solution from the dampening trough or pan and rotates at a speed which is variable but which nevertheless remains less than machine speed (the linear speed of the plate fixed on the plate cylinder). The disposition of this first group of rollers is designed so that one of the rollers in the group is covered with a uniform film of solution. A second group of rollers is organized in contact with the plate disposed on the plate cylinder and rotates at the same linear speed as the plate, enabling a dampening solution to be deposited thereon.

Solution is transferred between these two groups of rollers by sliding contact. Since all of the rollers are parallel to one another, and since they touch one another along generator lines (i.e., transverse contact zones), the film of dampening solution to be applied uniformly onto the plate is transported from roller to roller, from the pan roller in the first group to the dampening roller in the second group.

In film dampening systems, whenever two rollers touch along a generator line, two situations may arise:

either both rollers rotate with substantially the same linear speed, the linear speeds being related by a constant ratio, in which case the rollers can be pressed firmly against each other firmly; or else the two rollers rotate at linear speeds which are very different, in which case they are pressed more gently against each other so as to allow the rollers to slip relative to each other.

In general, the film dampening systems presently available on the market can be divided into two broad categories, namely three-roller "emulsion" dampening systems, and four-roller "independent" dampening systems.

Three-roller emulsion type film dampening systems comprise in succession: a pan roller covered with an elastomer and partially immersed in solution; a chromium-plated metering roller; and an elastomer-covered dampening form roller. In this system, the thickening of the dampening film on the metering roller is determined by the dampening solution passing between the elastomer-covered pan roller and the chromium-plated metering roller which are pressed against each other. A variable speed electric motor drives the pan roller and the chromium-plated metering roller which is coupled thereto by gearing. A dampening form roller is in contact with the plate of the plate cylinder and with a vibrated ink drum rotating at machine speed. The dampening form roller of the emulsion dampening system is thus the only one of the three rollers of the system to be driven at machine speed, with slipping contact being established directly on the surface of the form roller making contact with the metering roller.

Emulsion film dampening systems of the above-described type are illustrated, for example, in the following French patents: No. 1 374 410, No. 1 547 536, No. 2 058 506, No. 2 196 249 (which corresponds to U.S. Pat. No. 3,986,452), No. 2 274 366 (which corresponds to U.S. Pat. No. 3,937,141), and No. 2 448 978.

These film dampening systems, which are generally described below with reference to FIG. 1 of the accompanying drawings, have the advantage of limiting gap transfers by spreading out the excess water remaining on the form roller after passing over the plate gap, by virtue of its slipping contact with the metering roller, but they nevertheless suffer from the drawback of using high percentages of isopropyl alcohol for reducing surface tension (with the water-ink emulsion being made prior to contact on the plate).

Four-roller independent type film dampening systems comprise in succession: a partially immersed pan roller which is chromium-plated (or which is fitted with a hydrophilic material); an elastomer-covered metering roller; a dampening drum which is vibrated (i.e. a dampening "vibrator") and which is chromium-plated (or covered with a hydrophilic material); and an elastomer-covered dampening form roller. In this system, the thickness of the dampening film is defined by the pressure between the chromium-plated pan roller and the elastomer-covered metering roller. As in the emulsion systems, a variable speed electric motor drives the pan roller and the metering roller which is coupled thereto by gearing, whereas the dampening roller is driven at machine speed. In this type of system, the slipping contact therefore occurs between the elastomer-covered metering roller and the chromium-plated dampening roller (with the pressure between the metering roller and the dampening roller then being deliberately adjusted to "light"). The dampening form roller of the independent dampening system thus remains in contact with the dampening roller without slipping, and slipping takes place at the surface of the dampening roller between the dampening roller and the metering roller.

Such independent film dampening systems of the above-described type are illustrated, for example, in French patents No. 1 491 977 and No. 2 211 348 (which correspond to U.K. Patent No. 1,163,267 and U.S. Pat. No. 3,842,735, respectively).

Such film dampening systems, which are described generally below with reference to FIGS. 2 and 3 of the accompanying drawings, have the advantage of being capable of using relatively weak concentrations of alcohol, particularly because of the vibration of the dampening vibrator. However, they nevertheless suffer from the drawback of getting rid of gap transfers poorly (the excess water remaining on the dampening roller upon passing over the plate gap is squeezed at the area of contact between the roller and the dampening vibrator roller, but it is not sufficiently reduced since the contact is not a slipping contact).

Thus, each of the two above-mentioned film dampening systems has both advantages and drawbacks, and a user must make an initial choice as to which dampening system to use.

This can be somewhat restrictive insofar as the type of printed signature that is to be used and its coverage ratio, and also the types of defects that it is desired to eliminate in preference to others are not always definitive. Accordingly, it would be extremely advantageous to be able to use one dampening mode or the other depending on the circumstances.

Unfortunately, prior systems are not easily modified to switch from one mode to the other, and some simply cannot be transformed between modes.

An object of the present invention, therefore, is to propose a film dampening system which is dual-mode and convertible, capable of operating equally well in either of two different dampening modes, comprising an emulsion type mode and a four-roller independent type mode, thereby making it possible to use each mode to the best advantage depending on any given situation.

Another object of the present invention is to provide a film-dampening system which is easily converted, i.e., in which switching from one mode to another does not require long and difficult disassembly and adjustment operations.

Yet another object of the present invention is to provide a convertible dual-mode dampening system capable of being fitted equally well to sheet-fed and to web-fed rotary offset presses.

Other objects and advantages of the present invention will become apparent in view of the following detailed description and accompanying drawings.

SUMMARY OF THE INVENTION

The present invention is directed to a film dampening system for a rotary offset press, the system comprising:

- a pan roller rotated by a variable speed electric motor, the pan roller being covered with a hydrophilic material and being partially immersed in a trough containing dampening solution;
- an elastomer-covered metering roller rotating at a speed related to the speed of the pan roller;
- a dampening drum fitted with hydrophilic material; and
- an elastomer-covered dampening roller in contact with the dampening drum and with a plate cylinder of the press, wherein the dampening drum is selectively driven either from the metering roller, in which case inter-roller differential slipping is established between the dampening drum and the dampening roller, or else from the plate cylinder, in which case inter-roller differential slipping is established between the dampening drum and the metering roller, the selective drive for the dampening drum thus making it equally possible to use either one of two different dampening modes.

In one embodiment of the present invention, the dampening system comprises a declutchable coupling enabling the dampening drum to be connected either to the electric motor driving the pan roller and the metering roller, or else to the plate cylinder.

It is advantageous for the shaft of the dampening drum to carry a first gear wheel meshing with the outlet shaft of the electric motor, and a second gear wheel meshing with the shaft of the plate cylinder, the declutchable coupling constraining the dampening-drum shaft to rotate with one or the other of the first and second gear wheels while the other one is idle on the shaft. In particular, the declutchable coupling may comprise: a disk mounted on each end of the shaft of the dampening drum, each disk being located adjacent to a respective one of the first and second gear wheels, with coupling between each disk and the respective gear wheel being achieved by associated bolts.

Also, the declutchable coupling may preferably include interlock means for preventing simultaneous engagement of the dampening drum with both the electric motor and the plate cylinder; for example, the number of the above-mentioned connecting bolts provided may be just sufficient for coupling together only one disk and its corresponding gear wheel, thereby preventing any possibility of both disks being coupled simultaneously.

In an advantageous variation of the system of the present invention, the dampening system includes another variable speed electric motor directly driving the dampening drum, the speed of the other electric motor being servo-controlled either to the speed of the metering roller or else to the speed of the plate cylinder. More particularly, a tachometer generator may be provided mounted on the shaft of the plate cylinder, and a tachometer dynamo may be associated with each of the electric motors. An electronic servo-control circuit is in turn coupled to the motor driving the dampening drum for receiving signals either from the tachometer dynamo of the motor driving the pan roller, or else from the tachometer generator of the plate cylinder.

In another variation of the system of the present invention, the metering roller is also partially immersed in the trough, and mechanical means are provided for displacing the shaft of the pan roller, with differential slipping being established either between the dampening drum and the dampening roller when the pan roller is located a distance from the metering roller, or else between the dampening drum and the metering roller when the pan roller is brought into contact with the metering roller.

Preferably, the mechanical means for displacing the shaft of the pan roller includes brackets pivotally mounted on the frame of the press, and disposed on either side of the pan roller, each bracket including a position adjustment member. In particular, the brackets may pivot about respective tubes coaxial with the shaft of the metering roller, each adjustment member being made in the form of a screw having a knob and passing through two bearings mounted on the shafts of the pan roller and the metering roller, respectively.

The dampening system of the present invention may also advantageously include an independent vibrating mechanism associated with the dampening drum, in particular, a mechanism comprising a worm screw and a wheel, thereby causing the dampening drum to be displaced in both dampening modes with predetermined back-and-forth reciprocating motion.

According to another advantageous feature of the present invention, the dampening system further includes a bridging roller disposed between the dampening roller and the closest ink form roller, the bridging roller establishing contact in both dampening modes between the dampening roller and the ink form roller, and also participating in driving the dampening roller.

More particularly, the bridging roller may be mounted to idle, or else it may be driven at the speed of the plate cylinder.

It is advantageous for the bridging roller to be mounted on the frame of the press with an eccentric system enabling contact to be established or eliminated between the bridging roller and the dampening roller.

Other characteristics and advantages of the system of the present invention will become more clear in light of the following detailed description with reference to the accompanying drawings.

DETAILED DESCRIPTION

Figure 1:
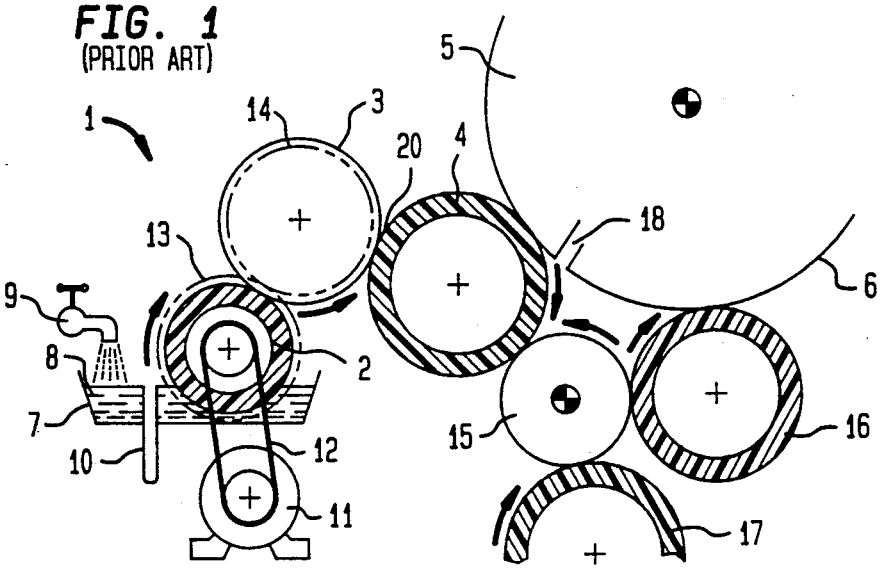
FIG. 1 (PRIOR ART)
FIG. 1 is a diagrammatic section view through a prior art three-roller emulsion type film dampening system.

FIG. 1 shows a prior art three-roller emulsion type dampening system 1.

As described above, the film dampening system 1 comprises, in succession: an elastomer-covered pan roller 2; a chromium-plated metering roller 3; and an elastomer-covered dampening form roller 4. The pan roller 2 is partially immersed in a dampening solution 8 disposed in a pan or trough 7, which is also provided with a constant supply of water (faucet 9) and an overflow (tube 10) ensuring that the level of the dampening solution in the trough or pan 7 remains constant. One of the rollers 2 and 3 (in this case the pan roller 2) is driven by a variable speed electric motor 11 via a belt 12 (or else via a transmission including a universal joint, not shown). The pan roller 2 is in contact with the chromium-plated metering roller 3, and these two rollers are interconnected by associated gearing 13, 14 (represented by dot-dashed lines). Because of the gear connection between the pan roller 2 and the metering roller 3, the speeds of these two rollers are proportional (and are generally in a ratio of 1 to 3).

The dampening roller 4 is in contact with the plate cylinder 5 around which the printing plate 6 is disposed. The dampening form roller 4 is also in contact with a vibrated ink drum 15 which is driven at machine speed. The ink drum is itself in contact with an intermediate inking roller 17 and an adjacent ink form roller 16 (the first of a group of three or four ink form rollers), which rollers form a part of the inking group of the rotary offset press. The dampening form roller 4 is thus driven at machine speed, while the chromium-plated metering roller 3 is driven by the electric motor 11. The dampening form roller 4 touches the chromium-plated roller 3 very lightly and slips thereover, taking a fine film of solution therefrom. In a film dampening system of this type, the thickness of the dampening film present on the metering roller is determined by the dampening solution passing between the pan roller 2 and metering roller 3 tightly clamped together. The differential slip zone (referenced 20 in this case) is situated at the line of contact between the metering roller 3 and the dampening form roller 4 (while the contact between the pan roller 2 and the metering roller 3 is either slip-free or is accompanied by slip at a fixed ratio, but is in any event not accompanied by differential slip).

As mentioned above, this type of dampening has the advantage of limiting gap transfers. The plate cylinder 5 has a gap 18 enabling the plate 6 to be put under tension and, as a result, excess water remains on the dampening form roller 4 when it moves past the gap 18. However, this fault is removed by the slipping contact 20 between the metering roller 3 and the dampening form roller by virtue of the differential slip between these rollers. In contrast, and as mentioned above, this type of dampening requires high percentages of isopropyl alcohol in order to operate properly, which is due to the fact that the water-ink emulsion is made prior to contact with the printing plate 6.

Figure 2:
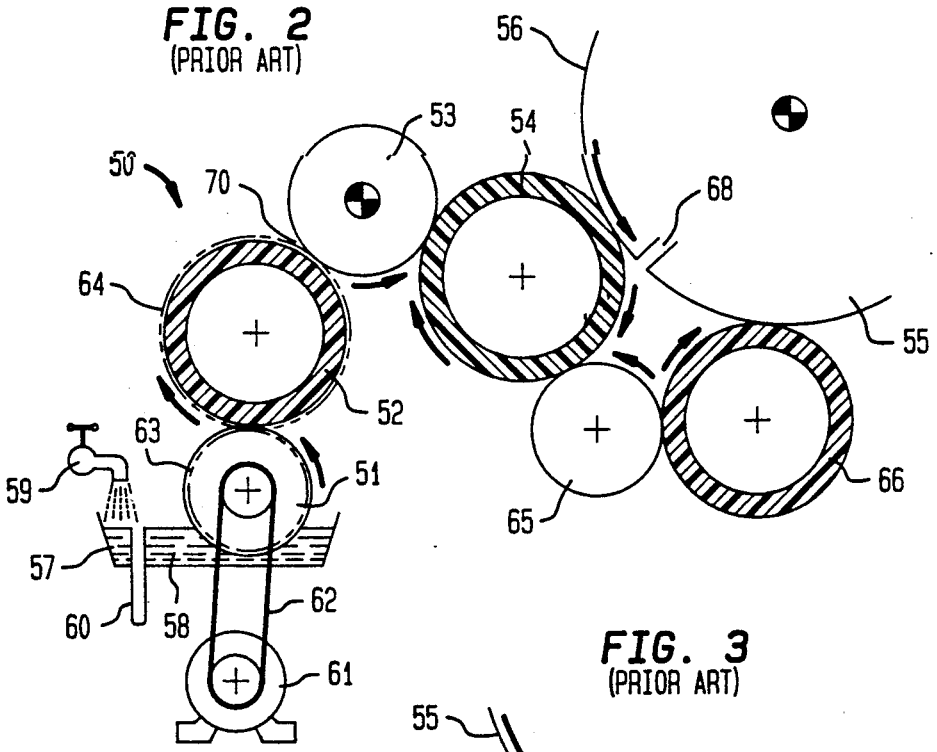
FIG. 2 (PRIOR ART)
FIG. 2 is a diagrammatic section view through a prior art four-roller independent type film dampening system.

FIG. 2 illustrates another prior art film moistening system, referred to above as "four-roller independent moistening".

Such a moistening system, given overall reference numeral 50, comprises in succession: a pan roller 51 which is partially immersed in a trough 57 of dampening solution 58, the pan roller 51 being chromium-plated, or being fitted with a hydrophilic material; an elastomer-covered metering roller 52; a dampening drum 53 which is chromium-plated (or fitted with a hydrophilic material) and which is vibrated; and finally an elastomer-covered dampening form roller 54. As above, drive is provided by a variable speed electric motor 61 and a belt 62, and a system is provided for guaranteeing an appropriate depth of dampening solution, by means of a faucet 59 and an overflow tube 60. The pan roller 51 and the metering roller 52 are interconnected by associated gearing 63 and 64, in the same manner as for the first pair of rollers in the emulsion dampening system as described above.

However, in this case the thickness of the film is defined by squeezing between the chromium-plated pan roller 51 and the elastomer-covered metering roller 52. As before, the dampening form roller 54 is in contact with the plate cylinder 55 carrying the printing plate 56, and its gap 68 can be seen. Thus, in a dampening system of this type, the dampening drum 53 is driven and vibrated, and its clamping against the adjacent metering roller 52 is adjusted to "low". Thus, the slipping contact (differential slipping) occurs between the metering roller 52 and the dampening drum 53 in a zone indicated by the reference numeral 70. The dampening roller 54, which applies the film of solution onto the printing plate 56, lies between two components rotating at machine speed, i.e., the plate 56 and the chromium-plated dampening drum 53, so that the excess water caused by the plate gap 68 is not removed and, indeed, is not even partially smoothed (unlike the above-mentioned emulsion system, the contact zone between the dampening drum 53 and the dampening roller 54 is in a slip-free zone, or in a zone where slipping takes place at a fixed ratio, and which therefore does not include any differential slipping).

Figure 3:
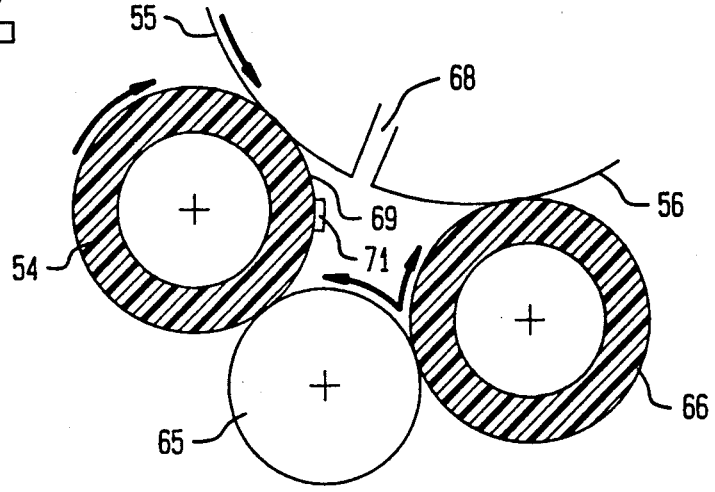
FIG. 3 (PRIOR ART)
FIG. 3 is an enlarged view of a portion of the system of FIG. 2 showing the gap transfer problem whereupon a "bulge" of excess water forms on the dampening form roller in the area where it moves past the plate gap.

FIG. 3 clearly shows the fault inherent due to the presence of the plate gap 68. In this figure, there can clearly be seen a portion of film 69 on the surface of the dampening roller 54, which portion is in the form of an isolated bulge 71 and corresponds to the area where the gap 68 of the printing plate 56 passes over the roller 54. The bulge 71 is formed by excess water which remains on the surface of the dampening roller 54 and which is merely squeezed on subsequent contact with the dampening drum 53 without being smoothed by virtue of the absence of differential slip at the area of contact between the rollers.

FIGS. 2 and 3 also show the presence of a bridging roller 65 disposed between the dampening roller 54 and the first ink form roller 66. The presence of this bridging roller 65 improves the operation of the dampening system 50 and, in particular, this operation is better than that of the emulsion dampening system 1 for certain printer signatures (it makes it possible to print using alcohol substitutes instead of high concentration alcohol, with the dampening vibration also making it possible to eliminate faults on the printed signature due to local scratches in the dampening roller or the chromium-plated roller).

As can he seen from the above description of prior art dampening systems, it is important to observe that in the emulsion dampening system 1 of FIG. 1, only the dampening form roller 4 rotates at machine speed, with slip relative to the other rollers taking place on its surface (differential slip at the area of slipping contact 20); whereas in the four-roller independent dampening system 50 shown in FIGS. 2 and 3, the dampening form roller 54 remains in slip-free contact (or in contact with slip at a fixed ratio) with the dampening vibrator drum 53, since both of these components are driven at machine speed, while slip relative to the remainder of the dampening rollers takes place on the surface of the dampening drum 53 (at the area of slipping contact 70 corresponding to the differential slip zone between the metering roller 52 and the dampening drum 53). In addition, in the four-roller dampening system 50, the dampening group includes the dampening drum 53 which is vibrated, thereby serving to reduce dampening non-uniformities in the direction of the machine's width.

A film dampening system embodying the present invention is hereinafter described, which system is dual-mode and convertible, being capable of operating equally well in either of two different dampening modes, comprising an emulsion type mode and a four-roller independent type mode, thereby making it possible to take best advantage of each dampening mode depending on any given particular situation.

Figure 4:
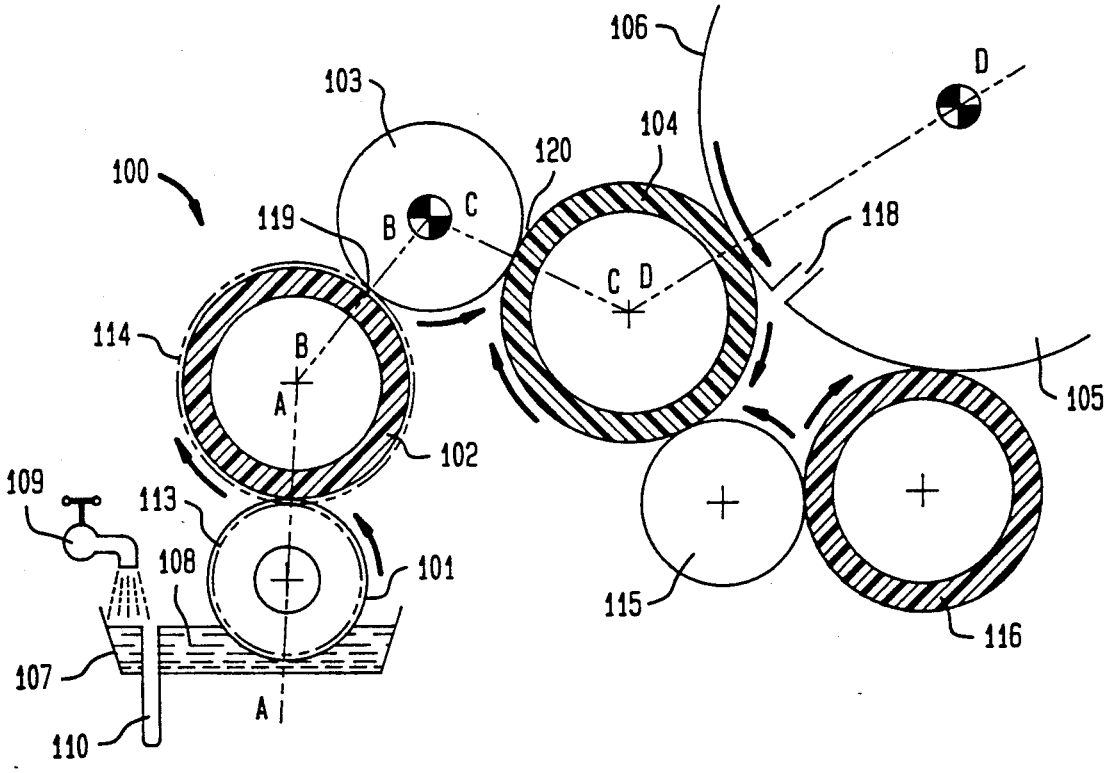
FIG. 4 is a diagrammatic section view through a convertible dampening system of the present invention.

With reference to FIG. 4, a film dampening system 100 comprises, in succession: a pan roller 101 partially immersed in a trough 107 containing dampening solution 108, the pan roller being rotated by a variable speed electric motor (not shown in this figure) and being fitted with a hydrophilic material (e.g., by having a chromium-plated outside surface); an elastomer-covered metering roller 102 whose speed of rotation is related to that of the pan roller 101; a dampening drum 103 fitted with a hydrophilic material (e.g., chromium-plated on the outside); and an elastomer-covered dampening roller 104 which is in contact with the dampening drum 103 and with the plate cylinder 105 of the press. The pan roller 101 and the metering roller 102 are interconnected by associated gearing 113 and 114 (indicated by broken lines) so that their speeds are proportional. The trough 107 of dampening solution similarly includes a constant water delivery member (faucet 109) and an overflow member (tube 110) analogous to the members described above.

So far, the film dampening system 100 of the present invention is in the form of a four-roller dampening system, similar to prior independent dampening systems as described above with reference to FIGS. 2 and 3. However, there is an essential difference between the dampening system 100 of the present invention and the prior four-roller independent system 50, with this difference relating to the way in which the dampening drum is driven.

In accordance with a characteristic feature of the present invention, the dampening drum 103 of the dampening system 100 is selectively driven either from the metering roller 102, in which case inter-roller differential slip is established between the dampening drum and the dampening roller 104 (slipping contact 120), or else it is driven from the plate cylinder 105, in which case inter-roller differential slip is established between the dampening drum and the metering roller 102 (slipping contact 119), with selective drive for the dampening drum 103 thus making it possible to use one or the other of two different dampening modes.

Thus, by providing selective drive for the dampening drum 103 either from the metering roller 102 or else from the plate cylinder 105, a film dampening system is provided which is both dual-mode and convertible, capable of operating equally well in either of two different dampening modes, namely an emulsion type mode and a four-roller independent type mode.

Figure 5A:
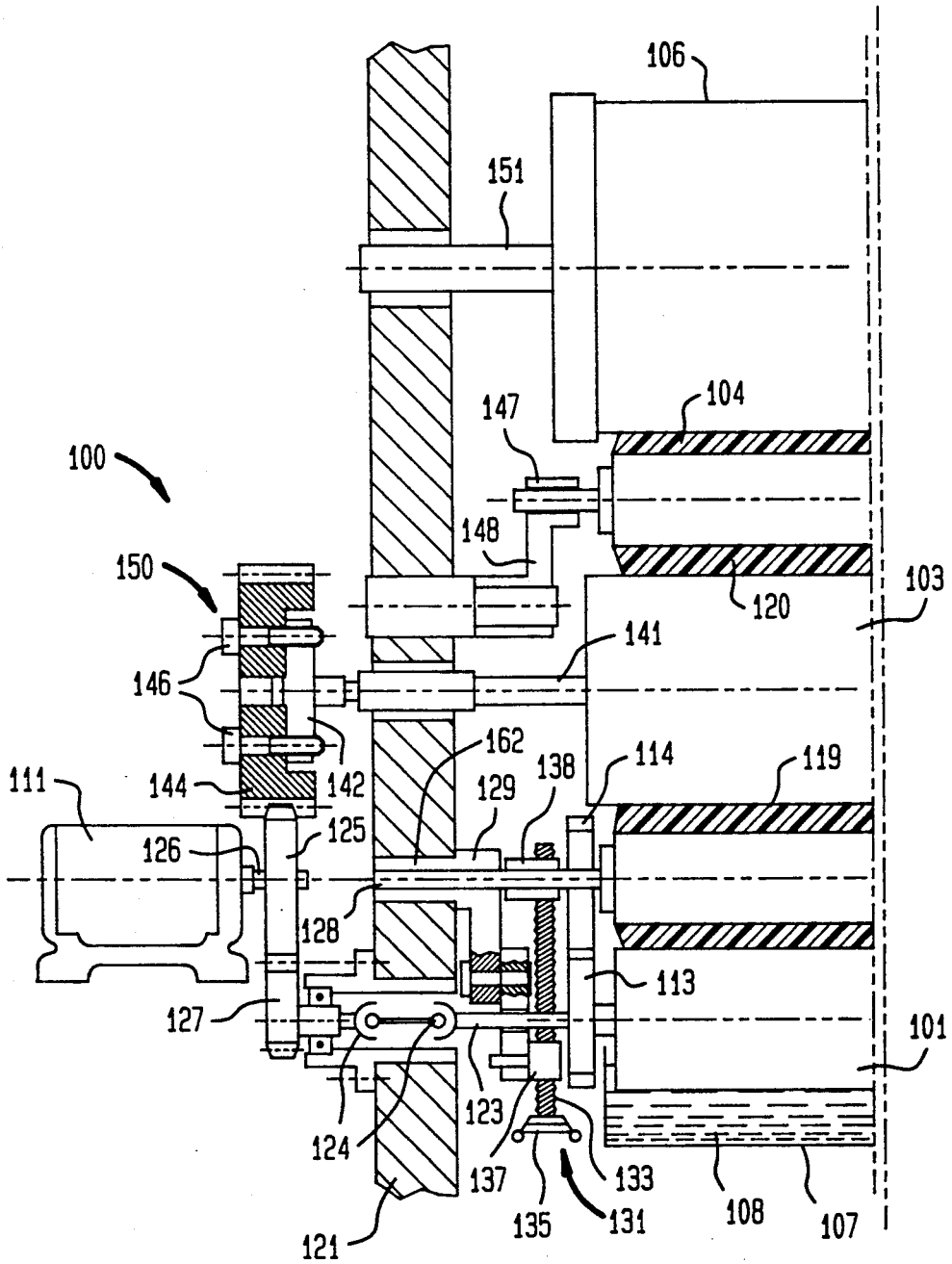
FIGS. 5*a* and 5*b* are fragmentary section views of the apparatus shown in FIG. 4 developed on a plane passing through the axes of the rollers along a line AA-BB-CC-DD of FIG. 4, these sections showing the electric motor for driving the pan roller, the declutchable coupling (in this case comprising a disk and a gear wheel that may be coupled together by bolts at each end of the shaft of the dampening drum), and the vibrator mechanism for the dampening drum.
Figure 5B:
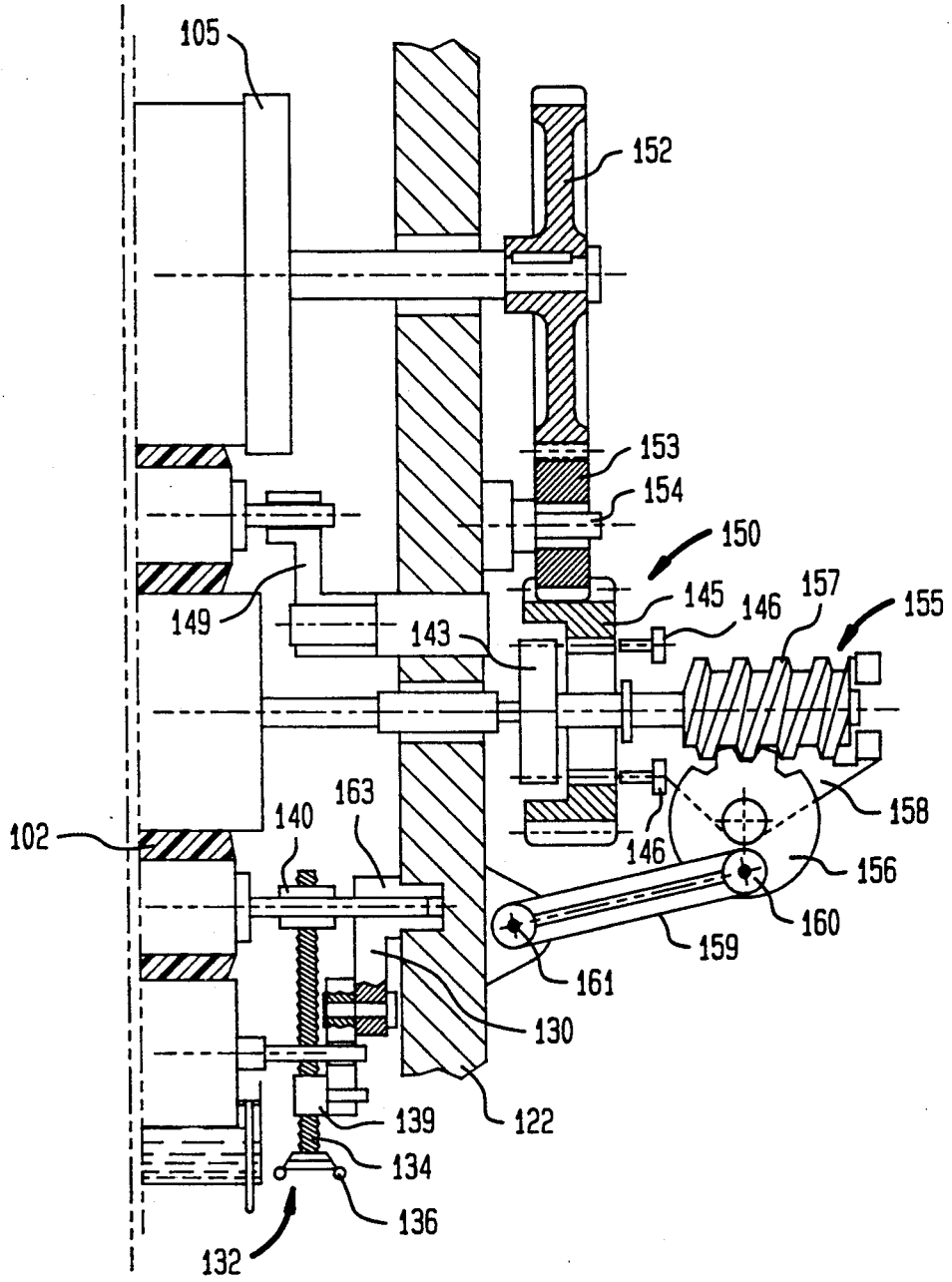

A first embodiment of this selective coupling for the dampening drum 103 is shown in FIGS. 5*a* and 5*b* which is hereinafter described.

The section of FIG. 5*a* shows the pan roller 101 which is partially immersed in the trough 107, the pan roller being driven by a variable speed electric motor 111. The outlet shaft 126 of the electric motor 111 is provided, for this purpose, With a gear wheel 125 meshing with another gear wheel 127 which is coaxial with the pan roller 101, and which is coupled to the shaft 123 of the pan roller via universal joints 124. The metering roller 102 rotates by means of its shaft 128 relative to the frame of the press (frame plate 121, FIG. 5*a*, being referred to as the "work-side" plate and frame plate 122, FIG. 5*b*, being referred to as the "gear-side" plate). Gears 113 and 114 interconnect the pan roller 101 and the metering roller 102. The chromium-plated dampening drum 103 is mounted to rotate relative to the frame plates 121 and 122 by means of its shaft 141, with a vibrator mechanism 155 being disposed at one end of the shaft, as shown in FIG. 5*b* and described in greater detail below. The dampening roller 104 is mounted by means of its shaft 147 on two brackets 148 and 149, which are in turn mounted to rotate relative to frame plates 121 and 122, respectively. Plate cylinder 105 carrying the printing plate 106 is mounted to rotate relative to frame plates 121 and 122 by means of its shaft 151.

In this case, the dampening system 100 includes a declutchable coupling 150 for connecting the dampening drum 103 either to the electric motor 111 driving the pan roller 101 and the metering roller 102, or else to the plate cylinder 105.

In this example, the shaft 141 of the dampening drum 103 carries a first gear wheel 144 meshing with the outlet shaft of the electric motor 111 (or more precisely in this case with the gear wheel 125 mounted on the outlet shaft 126 of the motor), and a second gear wheel 145 meshing with the shaft 151 of the plate cylinder 105 (or more precisely in this case with a gear wheel 152 keyed to the shaft 151 of the plate cylinder 105 and via an intermediate gear wheel 153 mounted to idle in a journal 154 fixed to the gear-side plate 122). The declutchable coupling 150 thus makes it possible to constrain the shaft 141 of the dampening drum 103 to rotate either with the first gear wheel 144, in which case the second gear wheel 145 idles on the shaft, or else with the second gear wheel 145, in which case it is the first gear wheel which idles on the shaft.

Naturally, there are numerous ways in which such a declutchable coupling can be provided by using conventional clutches using teeth or friction, and controlled electrically, mechanically, pneumatically or hydraulically. One particular embodiment of this declutchable coupling is shown herein and has the merit of being particularly simple and of further including interlock means preventing the dampening drum 103 from being engaged simultaneously with both the electric motor 111 and with the plate cylinder 105.

Thus, the declutchable coupling 150 comprises a disk 142 and a disk 143 mounted on either end of the shaft 141 of the dampening drum 103. Each disk 142 and 143 is located adjacent to a respective one of the first and second gear wheels 144 and 145, with coupling between the disk and the corresponding gear wheel 142, 144, or 143, 145 being provided by means of associated bolts 146. It can be seen that in this case each gear wheel 144 and 145 is provided with a recess for receiving the corresponding adjacent disk 142 or 143, which disk has tapped holes enabling the disk and the associated gear wheel to be fixed together by means of bolts 146. As will easily be understood, switching from one dampening mode to another merely requires the rotary press to be stopped, the bolts 146 present on one of the disk and gear wheel assemblies to be removed, and then to be reinstalled on the other side of the press in the other disk and gear wheel assembly.

When the declutchable coupling 150 connects the disk 142 to rotate with the first gear wheel 144 (FIG. 5*a*), then the dampening drum 103 is driven directly from the metering roller 102, in which case inter-roller differential slip takes place between the dampening drum 103 and the dampening roller 104 (contact zone 120). This corresponds to a dampening mode analogous to the above-described emulsion system, except insofar as this system has four rollers rather than only three. However, if the bolts 146 are used to connect the disk 143 to the second gear wheel 145 (FIG. 5*b*), then the gears 152 and 153 connect the shaft 141 of the dampening drum 103 to the shaft 151 of the plate cylinder 105, such that the dampening drum 103 is directly driven from the plate cylinder 105, with inter-roller differential slip then being established between the dampening drum and the metering roller 102, giving a dampening mode which is close to that of the above-described four-roller independent system.

Further, as mentioned above, the declutchable coupling 150 includes interlock means preventing the dampening drum 103 from being engaged simultaneously with the electric motor 111 and with the plate cylinder 105, with this being achieved by providing only the exact number of bolts 146 required for coupling just one of the disks 142 or 143 with the corresponding gear wheel 144 or 145, respectively. This provides a very simple method of being certain that there is no risk of both disks 142 and 143 being coupled simultaneously.

Thus, in accordance with a characteristic feature of the present invention, the film dampening system 100 includes a dampening drum 103 (in this case a chromium-plated cylinder) which is capable of being driven at the choice of the user either at machine speed or else at the linear speed of the metering roller 102 and of the pan roller 101, as provided by the independent electric motor 111.

Returning to FIG. 4, there can also be seen a bridging roller 115 disposed between the dampening roller 104 and the closest ink form roller 116. The bridging roller 115 establishes contact in both of the above-described dampening modes between the dampening roller 104 and the first ink form roller 116, and also participates in driving the dampening roller. Such a bridging roller is thus advantageous in that it not only provides water-ink bridging in a conventional manner, but it also provides assistance in driving the dampening roller 104, thereby making it possible to avoid having too high a pressure appearing between the dampening roller and the plate cylinder (with excess pressure at this level running the risk of drying up the film by a "mangle" effect). The pan roller 101, which rotates in the direction indicated by the arrow in FIG. 4, raises a film of solution to the line of contact between the pan roller 101 and the metering roller 102. The metering roller 102 squeezes this liquid film and limits its thickness, allowing only a much finer and much more uniform metered film to pass between the two rollers. The presence of the bridging roller 115 is particularly advantageous when operating in emulsion type dampening mode, since it ensures that the dampening roller 104 is properly driven. The bridging roller 115 is in contact with the first ink form roller 116, and particularly when passing the gap 118, it provides drive assistance in the pressure line between the dampening roller 104 and the printing plate 106.

As mentioned above, a vibrating mechanism 155 is also provided in association with the dampening drum 103, and one possible embodiment of this mechanism is shown in FIG. 5*b*. This figure shows a vibrating mechanism essentially constituted by a system comprising a worm screw 157 and a wheel 156, with the worm screw being fixed to the shaft 141 of the dampening drum 103, and with the wheel being provided with an eccentric system 160 providing a connection with frame plate 122 via a connecting rod 159 hinged at 161 to the frame. The Worm screw and wheel system is mounted in a moving housing 158 such that rotation of the dampening drum 103 produces back-and-forth reciprocating translation motion. Such a system is well known to those skilled in the art and may be achieved using other, equivalent means, and it is conventionally referred to as a vibrating mechanism. Its purpose is to impart small amplitude back-and-forth reciprocating motion (approximately plus or minus 8 mm) to the dampening drum 103 at a frequency of about 5 to 6 revolutions of the dampening drum per back-and-forth alternation. This frequency is actually defined by the gear ratio of the worm screw and wheel system. It should be observed that the vibrating mechanism 155 associated with the dampening drum 103 is organized to be suitable for use in both dampening modes, given that the adjacent declutchable coupling 150 is independent of the vibrating mechanism.

FIGS. 5*a* and 5*b* also show mechanical adjusting means 131 and 132 for adjusting the pressure applied between the metering roller 102 and the pan roller 101. Adjusting means 131 thus includes a bracket 129 pivotally mounted on the press frame plate 121, the bracket being capable of pivoting about a tube 162 which is coaxial with the shaft 128 of the metering roller 102. Two bearings 137 and 138 are associated with the shaft 123 of the pan roller 101 and with the shaft 128 of the metering roller 102, respectively, and a threaded rod 133 having a control knob 135 passes via these two bearings for the purpose of moving the bearings towards each other and away from each other by rotating the knob in the appropriate direction, thereby changing the pressure with which the two rollers in question are pressed against each other. At the other end of the same pair of rollers, there is naturally a symmetrical system, with the mechanical adjusting means 132 likewise comprising a bracket 130 mounted to pivot on frame plate 122 about a tube 163 coaxial with the shaft 128 of the metering roller 102, and a threaded rod 134 having an operating knob 136 serving to move bearings 139 and 140 associated with the shaft 123 of the pan roller 101 and with the shaft 128 of the metering roller 102, respectively, towards each other or away from each other.

The section of FIGS. 5*a* and 5*b* does not show the above-mentioned bridging roller 115, however, the use of such a roller is known in four-roller independent dampening systems such as the system 50 described above with reference to FIGS. 2 and 3. This bridging roller 115 may be mounted to rotate freely, or it may be driven at the speed of the plate cylinder 105. In addition, it is advantageous to provide for the bridging roller 115 to be mounted on the frame of the press via an eccentric system serving to establish or to remove contact between the bridging roller and the dampening roller 104.

As explained above, the dampening drum 103 may be driven either by the electric motor 111 via gears 125 and 144, bolts 146, and disk 142, or else from the cylinder plate 105 via gears 152, 153, and 145, the same bolts 146, and disk 143 (providing this disk is connected to the gear wheel 145 by the bolts 146). Thus, the dampening drum 103 rotates either at a linear speed as determined by the motor 111, or else at a linear speed as determined by the press, depending on the coupling used.

Two variations of the dampening system of the present invention are hereinafter described with reference to FIGS. 6*a*, 6*b* and 7, these variations including different means for achieving selective drive of the dampening drum 103, either from the metering roller or else from the plate cylinder, but still for the purpose of providing a film dampening system which is both dual-mode and convertible.

Figure 6A:
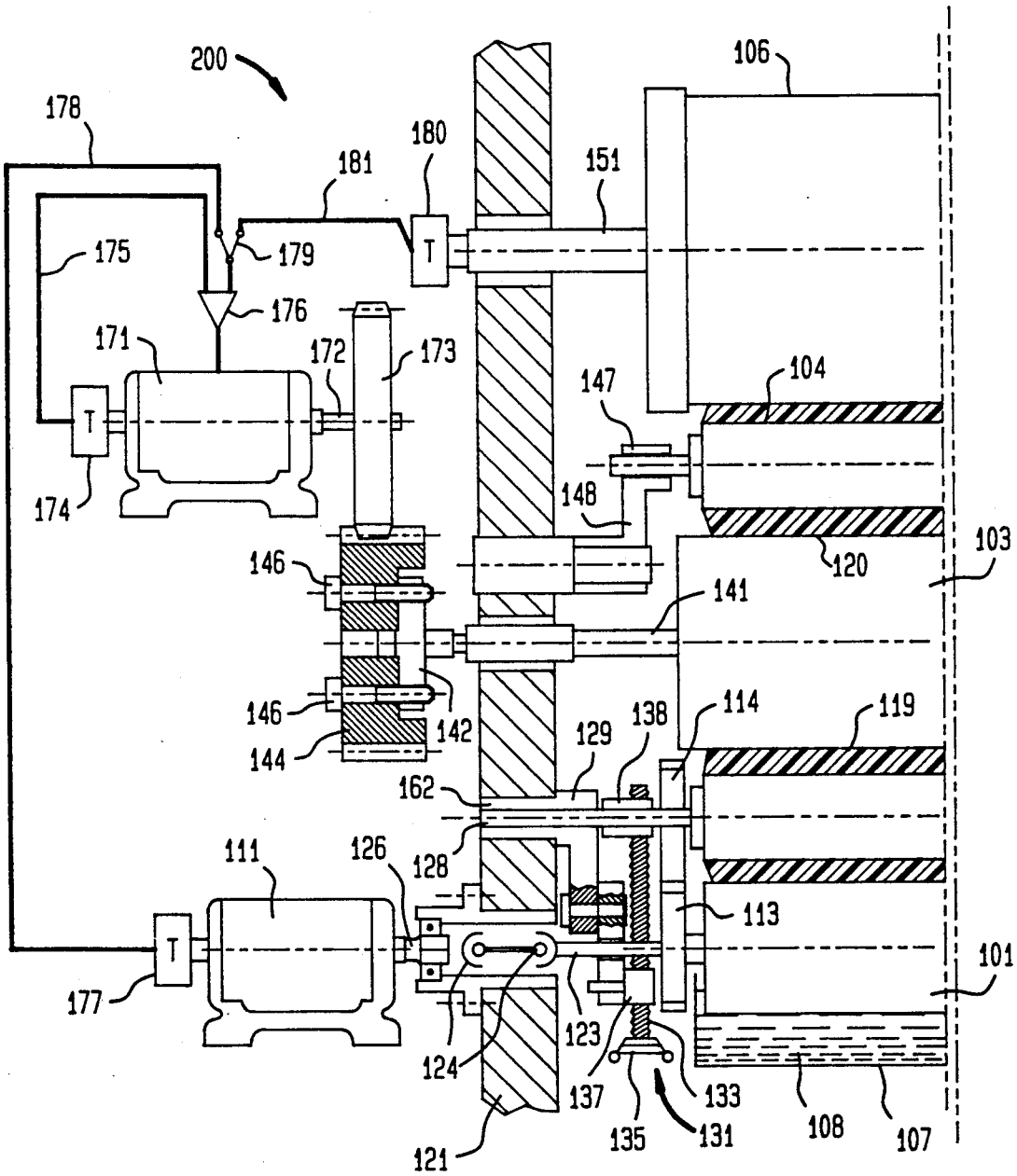
FIGS. 6*a* and 6*b* are sections analogous to FIGS. 5*a* and 5*b*, showing a variation of a system of the present invention in which the dampening drum is driven independently by a second electric motor whose speed of rotation is servo-controlled either to the speed of the pan roller or else to the speed of the plate cylinder.
Figure 6B:
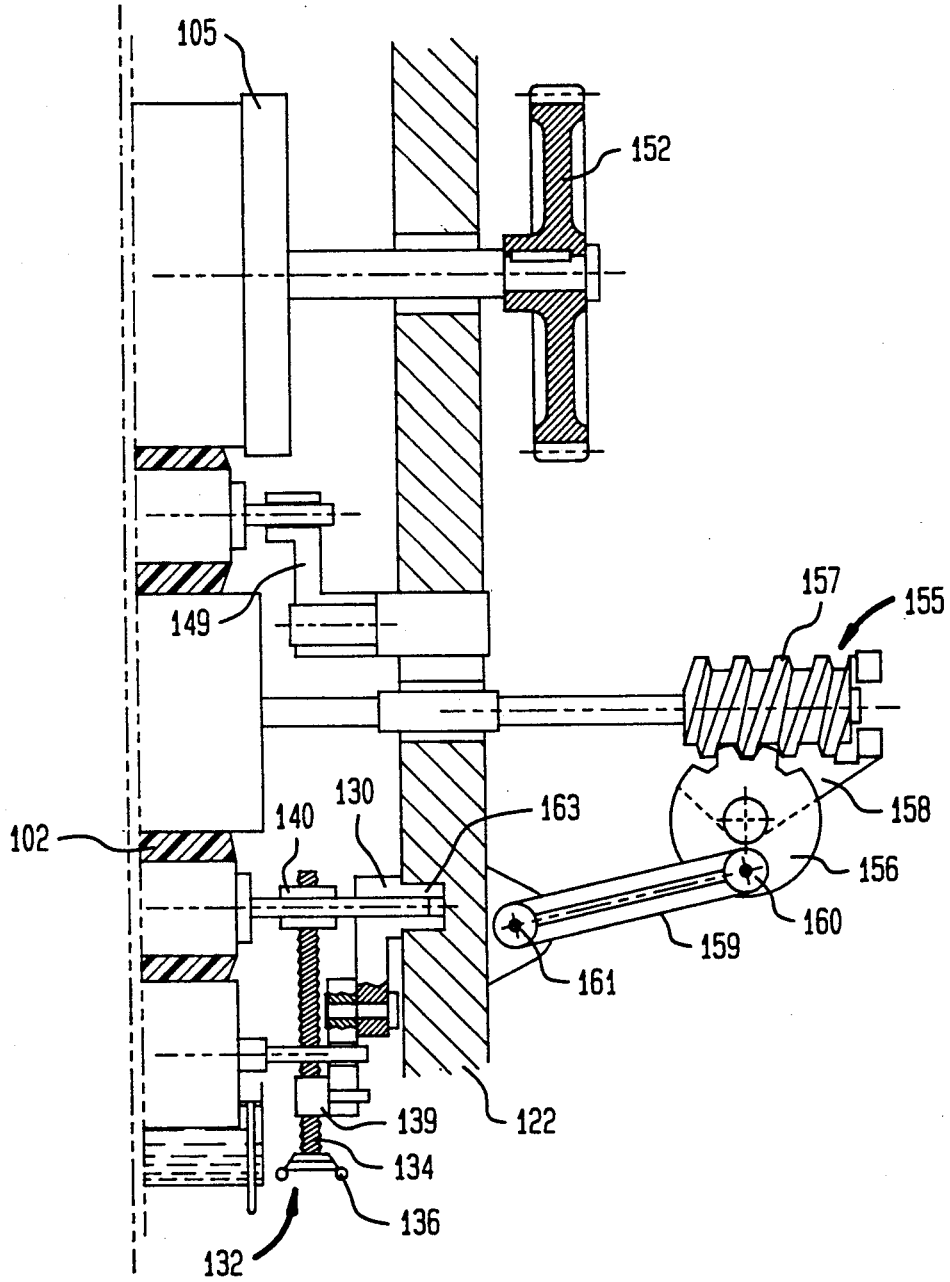

FIGS. 6*a* and 6*b* show a first variant of a dampening system of the present invention given overall reference numeral 200, and in which the dampening drum 103, instead of being suitable for connection to one gear wheel or to the other as selected by the user, is now driven on a permanent basis by a second electric motor, indicated by the reference numeral 171, which electric motor is likewise a variable speed motor.

The film dampening system 200 has numerous components which are common to the above-described film dampening system 100, and these components are therefore not described again.

In the dampening system 200, the shaft 141 of the dampening drum 103 still includes a vibrating mechanism 155, but it does not include the declutchable coupling 150 which was previously provided on both sides of the frame of the press. Nevertheless, it is possible to make use of the disk 142 and the first gear wheel 144 which is connected thereto by bolts 146, which components form a part of the preceding mechanism (naturally this functional assembly could be replaced by a single gear wheel constrained permanently to rotate with the shaft of the dampening drum).

A gear wheel 173 is provided on the outlet shaft 172 of the electric motor 171 and meshes with the gear wheel 144 of the dampening drum, thereby being capable of driving the dampening drum on a permanent basis. In addition, the electric motor 171 of the film dampening system 200 is servo-controlled in speed, either to the speed of the metering roller 102, or else to the speed of the plate cylinder 105, thereby making it possible to drive the dampening drum 103 either from the metering roller 102 or else from the plate cylinder 105, as in the above-described film dampening system, with such selective drive of the dampening drum 103 thus making it possible to use one or the other of two different dampening modes. Naturally, the above-specified speeds of the metering roller 102 and of the plate cylinder 105 are the linear speeds at the surfaces of the rollers.

The electric motor 171 is preferably servo-controlled in speed by an electronic speed servo-control circuit 176. The control circuit of the electric motor 171 can then be organized by providing a tachometric dynamo 177 associated with the electric motor 111 driving the pan roller 101 and the metering roller 102, another tachometric dynamo 174 being associated with the electric motor 171 driving the dampening drum 103, and a tachometric generator 180 being associated with the plate cylinder 105. The electronic speed servo-control circuit 176 thus receives signals from the tachometric dynamoes 177 and 174 via electrical connections 178 an 175, respectively, and signals from the tachometric generator 180 via an electrical connection 181. A switch 179 is provided at the input to the electronic servo-control circuit 176. When the switch 179 is in the position shown by continuous lines in FIG. 6*a*, the electronic servo-control circuit 176 receives signals from the tachometric dynamo 174 and the tachometric generator 180, which corresponds to servo-controlling the speed of the motor 171 to the speed of the plate cylinder 105 (in which case the dampening mode is of the four-roller independent dampening type), and when the switch 179 is in the position shown by dashed lines in FIG. 6*a*, the electronic servo-control circuit 176 receives signals from both tachometric dynamos 174 and 177, which corresponds to servo-controlling the speed of the motor 171 to the speed of the metering roller 102 (in which case emulsion type dampening mode applies).

Thus, in the emulsion type dampening mode, the reference voltage defining the speed of the motor 171 is provided by the tachometric dynamo 177 which is driven by the motor 111, such that the motor 171 rotates at a speed proportional to the speed of the motor 111. In contrast, in four-roller independent type dampening mode, the reference voltage provided to the servo-control circuit comes from the tachometric generator 180 which is connected to the press (in this case to the plate cylinder 105), and the motor 171 therefore rotates at a speed which is equal to or proportional to the speed of the press.

This variation of the system of the present invention is advantageous insofar as it makes it possible to switch very easily from one dampening mode to another, merely by operating the switch 179. However, it does require the use of a second variable speed electric motor.

Figure 7:
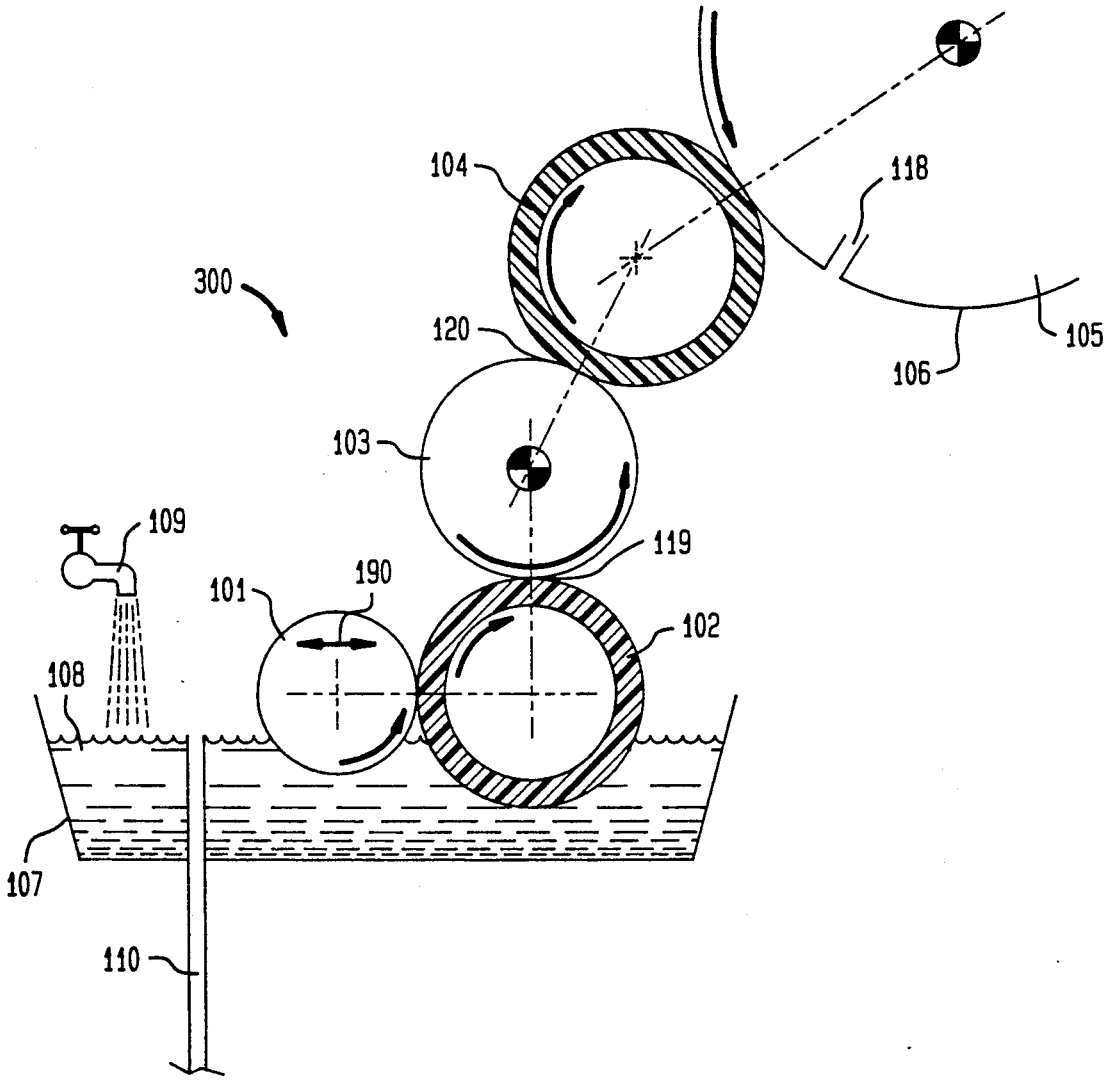
FIG. 7 is a diagrammatic section analogous to that of FIG. 4 showing another variation of a system of the present invention in which the metering roller is also partially immersed, and in which the pan roller is capable of being moved away from or pressed against the metering roller depending on which film dampening mode is to be used.

FIG. 7 illustrates another possible variation of the dampening system of the present invention, given overall reference 300, and in which the metering roller 102 is partially immersed in the trough 107 as is the pan roller 101. The pan roller 101, metering roller 102, dampening drum 103, dampening roller 104 and plate cylinder 105 in FIG. 7 are otherwise the same as shown in FIGS. 5*a* and 5*b* or FIGS. 6*a* and 6*b*. The pan roller 101 is driven by a variable speed electric motor 111, and the metering roller 102 is coupled to the pan roller 101 by gears 113 and 114, as shown in FIGS. 5*a* or 6*a*. The dampening drum 103 can be driven either by the electric motor 111 or by the plate cylinder 105, as shown in FIGS. 5*a* and 5*b*, or can be driven by another electric motor 171, as shown in FIGS. 6*a* and 6*b*.

The dampening system 300 organized in this way includes mechanical means for displacing the shaft of the pan roller 101 in such a manner that differential slip is established either between the dampening drum 103 and the dampening roller 104 when the pan roller is at a distance from the metering roller 102, or else between the dampening drum 103 and the metering roller 102 when the pan roller is brought into contact with the metering roller. Thus, in this other variant, an attempt is made to use the possibility of displacing the pan roller 101 transversely relative to the adjacent metering roller 102, which roller is also partially immersed (with such displacement being symbolized in FIG. 7 by an arrow 190).

The mechanical means provided for displacing the shaft of the pan roller 101 may be of a wide variety of types, and in particular, use may be made of the mechanical means 131 and 132 described above with reference to FIGS. 5*a* and 5*b*. However, in this case, the mechanical means 131 and 132 no longer serve only to adjust the pressure with which the pair of rollers in question press against each other, but also serve to displace the pan roller 101 between two different working positions, namely a "far" first position in which the pan roller 101 is at a distance from the metering roller 102, and a "near" second position in which the pan roller 101 is pressed hard against the metering roller 102.

When the pan roller 101 is moved away from the metering roller 102 by means of the position adjustment members 133, 135, and 134, 136 (FIGS. 5*a* through 6*b*), the metering roller 102, which rotates in the direction indicated by the arrow, raises a thick film which is deposited as it passes between the dampening drum 103 and the metering roller 102. In this operating mode, corresponding to the first working position of the pan roller 101, the metering roller 102 and the dampening drum 103 rotate at substantially equal speeds, while the dampening roller 104 continues to be driven at press speed. Differential slipping thus occurs in the zone 120 between the dampening roller 104 and the dampening drum 103, and the film is spread out where it passes between these two rollers, with the mutual pressure between them naturally being low in order to allow the differential slipping to take place. In this case, emulsion type dampening mode is operative.

In contrast, when the operator acts on the position adjusting members 133, 135, and 134, 136 (FIGS. 5*a* through 6*b*) so as to cause the pan roller 101 to press hard against the metering roller 102, then the thickness of the dampening film solution is defined by the passage between the pan roller 101 and the metering roller 102 which rotate at substantially the same speed, said speed being that imparted by the electric drive motor 111. The film is stretched upon being transferred to the dampening drum 103 which rotates at press speed, and in this case, passage from the dampening drum 103 to the dampening roller 104 is constituted merely by transfer between rollers rotating at substantially equal speeds. Differential slipping then takes place in the zone 119 between the metering roller 102 and the dampening drum 103. In this case, four-roller independent type dampening is operative.

The present invention is not limited to the embodiments described above, but to the contrary, it covers any variant which uses equivalent means to reproduce the characteristics specified in the appended claims.

In particular, it will be understood by those skilled in the art that the clutch mechanism for the dampening drum 103 shown herein could easily be replaced by any other type of clutch mechanism, such as a positive clutch, a friction clutch, etc. Similarly, the independent worm screw and wheel vibrating device could be replaced by any other equivalent device, e.g., a fast acting electromagnetic clutch or a mechanical positive action clutch.

Naturally, the bridging roller 115 is not essential in a film dampening system of the present invention insofar as the dampening roller 104 could be driven mechanically in a variant by gearing driven by the press (e.g., the plate cylinder), such that the bridging roller would no longer be essential for its drive function (although with such a disposition there would be a danger of vibration which could disturb printing uniformity).

Nevertheless, the bridging roller 115 remains highly advantageous, and it may either be a metal roller having a surface which is easily wetted by ink (plastic or copper), or else it may be covered with elastomer. In general, this bridging roller is preferably provided with an eccentric system for establishing or eliminating contact between the bridging roller and the dampening roller.

It should also be understood that various secondary devices, such as the eccentric mechanism for the dampening roller, the metering roller, or the bridging roller have not been described herein, and nor have the systems for adjusting the rollers, these systems being of a type conventional in all currently used dampening systems.

I claim:

1. A dampening system for a rotary press, comprising:

a pan roller rotatably driven by a first motor and including a hydrophilic covering and being at least partially immersed in a container of dampening solution;

a metering roller including an elastomeric covering for rotation in contact with the pan roller;

a dampening drum including a hydrophilic covering;

a dampening roller including an elastomeric covering for rotation in contact with the dampening drum and a plate cylinder of the press; and means for selectively driving the dampening drum at a speed corresponding to the speed of the metering roller to establish inter-roller differential slipping between the dampening drum and the dampening roller, or at a speed corresponding to the speed of the plate cylinder to establish inter-roller differential slipping between the dampening drum and the metering roller, thus making it possible to use either of two different dampening modes, wherein the means for selectively driving includes a second motor coupled to the dampening drum for rotatably driving the dampening drum.

2. A dampening system as defined in claim 1, wherein the means for selectively driving further includes a tachometer generator coupled to a shaft of the plate cylinder, a first tachometer dynamo coupled to the first motor, a second tachometer dynamo coupled to the second motor, and a servo-control circuit coupled to the second motor and to the tachometer generator and to the first and second tachometer dynamos for receiving output signals transmitted by either the tachometer generator and the second tachometer dynamo or the first and second tachometer dynamos, according to the position of a selector switch for controlling the second motor based on the output signals.

3. A dampening system as defined in claim 1, further comprising a means for displacing the pan roller relative to the metering roller, wherein the metering roller is at least partially immersed in the container of dampening solution, and the pan roller is spaced from the metering roller when the dampening drum is driven at a speed corresponding to the speed of the metering roller to establish differential slipping between the dampening drum and the dampening roller, and the pan roller is moved into contact with the metering roller when the dampening drum is driven at a speed corresponding to the speed of the plate cylinder to establish differential slipping between the dampening drum and the metering roller.

4. A dampening system as defined in claim 3, wherein the means for displacing includes two bracket members located on either side of the pan roller relative to each other and each being pivotally coupled to a frame member of the press, each bracket member including a position adjustment member coupled to a shaft of the pan roller for adjusting the position of the pan roller relative to the metering roller.

5. A dampening system as defined in claim 4, wherein each bracket member is pivotally coupled to the respective frame member by means of a respective tube member coaxial with a shaft of the metering roller, wherein each adjustment member includes a threaded portion coupled to a bearing housing on the metering roller shaft, the position of the pan roller thus being adjustable relative to the metering roller by rotating the threaded portions of the bracket members.

6. A dampening system as defined in claim 1, further comprising a vibrating mechanism coupled to the dampening drum, the vibrating mechanism including a worm screw coupled to a shaft of the dampening drum and a wheel member coupled to the worm screw, wherein the movement of the wheel member is controlled to move the worm screw and, in turn, cause the dampening drum to reciprocate while rotating.

7. A dampening system as defined in claim 1, further comprising a bridging roller for rotating in contact with the dampening roller and an ink form roller.

8. A dampening system as defined in claim 7, wherein the bridging roller rotates freely between the dampening roller and the ink form roller.

9. A dampening system as defined in claim 7, wherein the bridging roller is driven at the speed of the plate cylinder for assisting in driving the dampening roller.

10. A dampening system as defined in claim 1, wherein the first and second motors are variable speed electric motors.

11. A method for applying dampening solution to a plate cylinder of a rotary press comprising the steps of:

rotatably driving a pan roller, at least partially immersed in a container of dampening solution with a first motor;

transferring dampening solution from the pan roller to a metering roller which rotates in contact with the pan roller;

transferring the dampening solution from the metering roller to a dampening drum;

rotatably driving the dampening drum at a speed corresponding to the speed of the metering roller to establish inter-roller differential slipping between the dampening drum and a dampening roller, or at a speed corresponding to the speed of a plate cylinder to establish inter-roller differential slipping between the dampening drum and the metering roller, thus making it possible to use either of two different dampening modes, with a means for selectively driving the dampening drum which includes a second motor coupled to the dampening drum for rotatably driving the dampening drum; and transferring the dampening solution from the dampening roller to the plate cylinder.

12. A dampening system for a rotary press, comprising:

a pan roller rotatably driven by a first motor and including a hydrophilic covering and being at least partially immersed in a container of dampening solution;

a metering roller including an elastomeric covering for rotation in contact with the pan roller;

a dampening drum including a hydrophilic covering;

a dampening roller including an elastomeric covering for rotation in contact with the dampening drum and a plate cylinder of the press; and a means for selectively driving the dampening drum at a speed corresponding to the speed of the metering roller to establish inter-roller differential slipping between the dampening drum and the dampening roller, or at a speed corresponding to the speed of the plate cylinder to establish inter-roller differential slipping between the dampening drum and the metering roller, thus making it possible to use either of two different dampening modes, wherein the means for selectively driving includes a disengagable coupling for selectively coupling the dampening drum to the first motor or to the plate cylinder for being driven with the plate cylinder, the disengagable coupling includes a first gear coupled to a shaft of the dampening drum for coupling to the first motor for driving the dampening drum with the pan and metering rollers, a second gear coupled to the shaft of the dampening drum for coupling to a shaft of the plate cylinder to drive the dampening drum with the plate cylinder, the disengagable coupling causing the dampening drum to be selectively rotated with one or the other of the first and second gears, whereupon rotation with one gear, the other gear remains idle on the shaft of the dampening drum, and two disks, each disk being coupled to an opposite end of the shaft of the dampening drum relative to the other disk for coupling to the first or second gears, respectively, wherein the dampening drum is coupled to the first motor by coupling the respective disk to the first gear and the dampening drum is coupled to the plate cylinder by coupling the respective disk to the second gear.

13. A dampening system as defined in claim 12, further comprising means for preventing the dampening drum from being simultaneously coupled to both the first motor and the plate cylinder.

14. A dampening system as defined in claim 13, wherein the means for preventing simultaneous coupling includes a number of fastening members for coupling each disk to the first or second gears, respectively, wherein the number of fastening members is only sufficient to couple one disk to a respective gear at a time, thus preventing the other disk from being coupled to the other gear.

15. A dampening system for a rotary press, comprising:

a pan roller rotatably driven by a first motor and including a hydrophilic covering and being at least partially immersed in a container of dampening solution;

a metering roller including an elastomeric covering for rotation in contact with the pan roller;

a dampening drum including a hydrophilic covering;

a dampening roller including an elastomeric covering for rotation in contact with the dampening drum and a plate cylinder of the press;

a means for selectively driving the dampening drum at a speed corresponding to the speed of the metering roller to establish inter-roller differential slipping between the dampening drum and the dampening roller, or at a speed corresponding to the speed of the plate cylinder to establish inter-roller differential slipping between the dampening drum and the metering roller, thus making it possible to use either of the different dampening modes, wherein the means for selectively driving includes a disengagable coupling for selectively coupling the dampening drum to the first motor or to the plate cylinder for being driven with the plate cylinder; and a means for displacing the pan roller relative to the metering roller, wherein the metering roller is at least partially immersed in the container of dampening solution, and the pan roller is spaced from the metering roller when the dampening drum is driven at a speed corresponding to the speed of the metering roller to establish differential slipping between the dampening drum and the dampening roller, and the pan roller is moved into contact with the metering roller when the dampening drum is driven at a speed corresponding to the speed of the plate cylinder to establish differential slipping between the dampening drum and the metering roller.

16. A dampening system as defined in claim 15, wherein the means for displacing includes two bracket members located on either side of the pan roller relative to each other and each being pivotally coupled to a frame member of the press, each bracket member including a position adjustment member coupled to a shaft of the pan roller for adjusting the position of the pan roller relative to the metering roller.

17. A dampening system as defined in claim 16, wherein each bracket member is pivotally coupled to the respective frame member by means of a respective tube member coaxial with a shaft of the metering roller, wherein each adjustment member includes a threaded portion coupled to a bearing housing on the pan roller shaft and a bearing housing on the metering roller shaft, the position of the pan roller thus being adjustable relative to the metering roller by rotating the threaded portions of the bracket members.

18. A method for applying dampening solution to a plate cylinder of a rotary press comprising the steps of:

rotatably driving a pan roller, at least partially immersed in a container of dampening solution with a first motor;

transferring dampening solution from the pan roller to a metering roller which rotates in contact with the pan roller;

transferring the dampening solution from the metering roller to a dampening drum;

rotatably driving the dampening drum at a speed corresponding to the speed of the metering roller to establish inter-roller differential slipping between the dampening drum and a dampening roller, or at a speed corresponding to the speed of a plate cylinder to establish inter-roller differential slipping between the dampening drum and the metering roller, thus making it possible to use either of two different dampening modes, with a means for selectively driving the dampening drum which includes a disengagable coupling for selectively coupling the dampening drum to the first motor or to the plate cylinder for being driven with the plate cylinder, the disengagable coupling includes a first gear coupled to a shaft of the dampening drum for coupling to the first motor for driving the dampening drum with the pan and metering rollers, a second gear coupled to the shaft of the dampening drum for coupling to a shaft of the plate cylinder to drive the dampening drum with the plate cylinder, the disengagable coupling causing the dampening drum to be selectively rotated with one or the other of the first and second gears, whereupon rotation with one gear, the other gear remains idle on the shaft of the dampening drum, and two disks, each disk being coupled to an opposite end of the shaft of the dampening drum relative to the other disk for coupling to the first or second gears, respectively, wherein the dampening drum is coupled to the first motor by coupling the respective disk to the first gear and the dampening drum is coupled to the plate cylinder by coupling the respective disk to the second gear; and transferring the dampening solution from the dampening roller to the plate cylinder.

* * * * *